US006724606B2

(12) United States Patent
Seale et al.

(10) Patent No.: US 6,724,606 B2
(45) Date of Patent: Apr. 20, 2004

(54) SINGLE-WINDING DUAL-LATCHING VALVE ACTUATION SOLENOID

(76) Inventors: Joseph B. Seale, 98 Day Rd., Gorham, ME (US) 04038; Gary E. Bergstrom, 191 Miles Rd., Moreland Hills, OH (US) 44022

( * ) Notice: Subject to any disclaimer, the term of this patent is extended or adjusted under 35 U.S.C. 154(b) by 162 days.

(21) Appl. No.: 10/094,335

(22) Filed: Mar. 8, 2002

(65) Prior Publication Data

US 2003/0169552 A1 Sep. 11, 2003

(51) Int. Cl.[7] ..... H01H 9/00
(52) U.S. Cl. ..... 361/160; 361/152; 361/166
(58) Field of Search ..... 361/152, 154, 361/160, 166, 143; 251/129.03, 129.1

(56) References Cited

U.S. PATENT DOCUMENTS 5,529,281 A * 6/1996 Brudnicki et al. ..... 251/129.03
6,043,730 A * 3/2000 Maenishi et al. ..... 335/229
6,249,418 B1 6/2001 Bergstrom ..... 361/152

FOREIGN PATENT DOCUMENTS

EP 0 992 658 A1 12/2000 ..... F01L/9/04

* cited by examiner

*Primary Examiner*—Anthony Dinkins
(74) *Attorney, Agent, or Firm*—Pierce Atwood

(57) ABSTRACT

A solenoid with two magnetically separate yoke regions, providing two distinct armature latching positions, is driven by a single effective winding. In one embodiment, the yoke regions consist of U-cores on either side of the armature and a single winding consisting of multiple turns, each turn looping through both U-cores and looping around the ends of the armature. In a second embodiment, distinct winding regions associated with the separate yoke regions are interconnected in series to make a single effective winding. Passage of the armature across a defined central position of minimum inductance is detected electrically, permitting a determination of absolute flux at a position of known inductance and thereby initializing a flux integration over time.

11 Claims, 3 Drawing Sheets

SINGLE-WINDING DUAL-LATCHING VALVE ACTUATION SOLENOID

FIELD OF THE INVENTION

The invention relates to solenoid systems for the actuation of engine valves. More specifically, the invention relates to methods for minimizing wiring and electronic complexity in such solenoid systems while retaining full functionality, including an ability to latch solenoids for both valve-open and valve-closed positions and an ability to control armature trajectories for quick transition with controlled impact velocity.

BACKGROUND OF THE INVENTION

Solenoid systems for electromagnetic actuation of engine valves are well known in the art. These systems are required to move a valve shaft between open and closed latching positions that are relatively far apart (e.g., one centimeter), completing each transition in a short time interval (e.g., 3 milliseconds or less). The most commonly seen and successful designs rely on a single armature traveling between two independently-controlled magnetic yokes, each yoke including its own separate electrical winding powered by a separate drive circuit. In U.S. Pat. No. 6,249,418, Bergstrom describes systems and methods whereby servo-controlled actuation of each of the two yokes is controlled entirely via pairs of conducting wires, one pair per yoke. Interpretation of the relationships among current, voltage, and time for each pair of wires is used to calculate the mechanical armature position to be controlled, leading to closed-loop servo control without separate sensing hardware or wiring. Even taking full advantage of the controller taught by Bergstrom, however, two independent sets of circuitry, independently connected to the two yoke windings, are required for full control of a dual-latching actuation system.

For an electric valve actuation system developed for Sagem, in European Patent EP0992658, Thierry et. al. describe a simplified actuation system achieving solenoid action of a single armature with latching in either of two positions. A single winding creates a magnetic potential difference across space, i.e., north and south magnetic poles in separate locations partially enclosing a gap space. Each of two curving jaws of the yoke carries a magnetic polarity, one jaw at north polarity and the other at south. Each of the jaws meets one end of the moving armature in either of two axial latching positions. When the armature is far off-center near one of these latching positions, magnetic forces predominate across the smaller yoke-armature gap on the side close to latching, giving rise to a strong force toward completed closure and latching on that side. Thus, application of current to the single winding can be used to latch the armature in either of two positions. There are two significant drawbacks to the invention taught by Sagem. First, the geometric constraints of bringing magnetic flux down from a winding on the top end of the solenoid (with the valve on the bottom end, opposite the winding) result in a substantial increase in the footprint area of the solenoid, as compared to comparable conventional solenoids with separate windings. Space is required for the flux cross-section to bring flux down to the bottom latching poleface area. Further space is required to provide an adequate gap between the armature and the vertical portions of the yoke, those portions conducting flux from the winding above to the lower latching poleface surfaces. Narrowing this gap causes high leakage of flux across the armature for all axial positions in the armature travel, resulting in flux that creates no axial attraction for moving the solenoid armature along its intended travel axis, but flux that nevertheless uses flux-carrying capacity in both armature and yoke. The non-functional flux results in added winding inductance. The second drawback, related to the first in engineering tradeoffs, is that the leakage flux across the armature in its middle range of travel is quite large for any practical gap allowance between the armature and the flux-conducting yoke bridges between the upper and lower poleface areas for attraction and latching. Leakage flux uses valuable and limited flux-carrying capacity, lowering the maximum axial force achievable within yoke saturation limits.

OBJECTS OF THE INVENTION

In light of the drawbacks and limitations of the prior art, it is an object of the current invention to generate magnetic flux separately in upper and lower magnetic yokes of a dual-latching valve actuation solenoid, avoiding ferromagnetic flux bridges from top to bottom, but employing a single winding or interconnected set of windings, operated from a single pair of electrical terminals. It is an object, in one embodiment of the invention, to generate magnetomotive force for latching in both top and bottom armature positions, using a single winding that surrounds the armature above, below, and across either end, thus concentrating magnetomotive force maximally in the armature and reducing flux that leaks between yoke parts without bridging between yoke and armature. In other embodiments of the invention, it is an object to create a single effective winding including series-connected parts in both upper and lower winding window areas of the yoke, thus driving and generating flux in both yokes from a single electrical circuit. It is a related object to configure a dual-latching solenoid so that magnetic flux flowing in the wider-gapped side of the solenoid is minimized. In the context of any of the above physical and electromagnetic embodiments, it is an object to use current and voltage information from the operation of the single effective winding to determine the time that the armature crosses a central location of minimum inductance, and from information involving the value and variation of current and voltage at that crossing, to determine the flux linkage and velocity of the armature in passing that location.

SUMMARY OF THE INVENTION

A common solenoid design uses a single armature and two separate yokes, each with a separate winding and separate drive circuitry, for moving the armature back and forth and for latching the armature in a first latching position against the first yoke, or a second latching position against the second yoke. Thus, the solenoid has four electrical terminals, two for each coil, or a minimum of three terminals if the two coils share a common voltage, e.g., ground potential. Separate control of electrical excitation of the two yokes is not always necessary, however. A saving in cost and complexity is obtained if the dual-latching solenoid is configured as a two-terminal device, behaving like a single load for a single driver circuit. When control is incorporated, that driver circuit may consist of a single voltage drive with current sensing, or alternatively as a single current drive with voltage sensing. The solenoid then has one effective coil circuit, even though that one coil circuit may include series connection of two winding regions, one for each of the two yokes. This configuration would appear to entail a considerable loss of efficiency, as well as control problems. As is shown in the following Specification, however, a one coil configuration for a dual latching solenoid has unsuspected advantages.

An advantageous embodiment of the one coil solenoid is illustrated in FIGS. 1*a* and 1*b*. Two U-core yokes attract a single armature to either of two latching positions. A single winding loops through both yokes and around the ends of the armature with each turn. The armature latches efficiently in contact with either of the two yokes. The system is made unsymmetrical by designing the mechanical spring restoration system to have a neutral point some distance away from the point of magnetic force balance, so that a current flowing through the winding exerts a force to move the armature away from that neutral point. Rhythmic application of coil current at a natural resonance frequency of the armature, its payload (e.g., a valve), and the spring system, makes it possible to excite the armature to a large amplitude oscillation and latch it. Once latched, the system can be released for re-latching on the opposite side. A controller, for example having a voltage driver and current sense circuitry (as drawn) can move the armature and detect when the armature passes a reference position of minimum solenoid inductance, obtaining timing information useful for control. The controller can also determine the absolute flux linkage, that is, the flux electromagnetically linking the winding turns (henceforth commonly referred to simply as "flux"), at this point of crossing over minimum inductance position. Other embodiments are shown, using separate yokes with separate windings, one for each yoke, but with the windings interconnected in series to form one effective coil circuit.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

FIGS. 3*a* and 1*b* show, by their combination of views, a variation on the solenoid of FIGS. 3*a* and 3*b* in which side-by-side windings encircling the armature offer potential performance advantages over the top-and-bottom winding configuration of FIGS. 3*a* and 3*b*.

DETAILED DESCRIPTION OF THE INVENTION

Figure 1A:
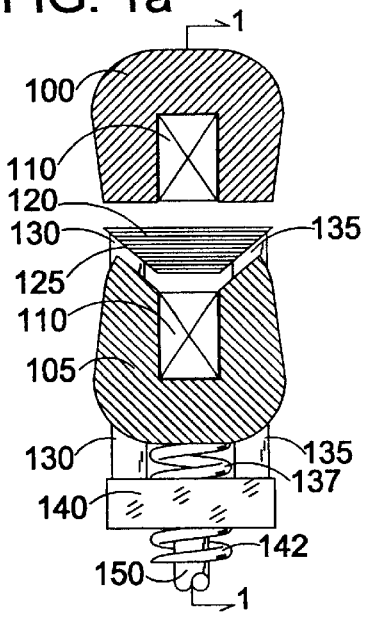
FIGS. 1*a* and 1*b* illustrate, in end-elevation and side-elevation section views, a dual-latching solenoid consisting of over-and-under U-core yokes magnetically excited by a single winding, wound through the gaps in the middles of the two U-cores and wrapping around the ends of the armature, which moves up and down between the yokes. The configuration includes dual side-by-side shafts to guide armature motion while constraining rotation about the axis of motion and avoiding shafts penetrating the winding area. Magnetic asymmetries in this and the following figures permit exertion of a starting force on an armature initially at rest in a middle position.

Referring to the drawings wherein identical reference numerals denote the same elements throughout the various views, FIG. 1

The invention employs a single moving armature structure in conjunction with two yoke structures being, magnetically, substantially separate, but electrically, commonly driven by a single effective winding and one drive circuit. Embodiments for the invention fall into two categories, the first applicable to an over-and-under pair of U-core yokes, the second category applicable to geometries with greater subdivision of the ferromagnetically conducting yoke structures. This greater subdivision may be into dual U-core yokes in both over and under positions relative to the armature. Alternatively, the greater subdivision may be into multipole yokes, such as E-core yokes, for both the over and under positions.

Figure 1B:
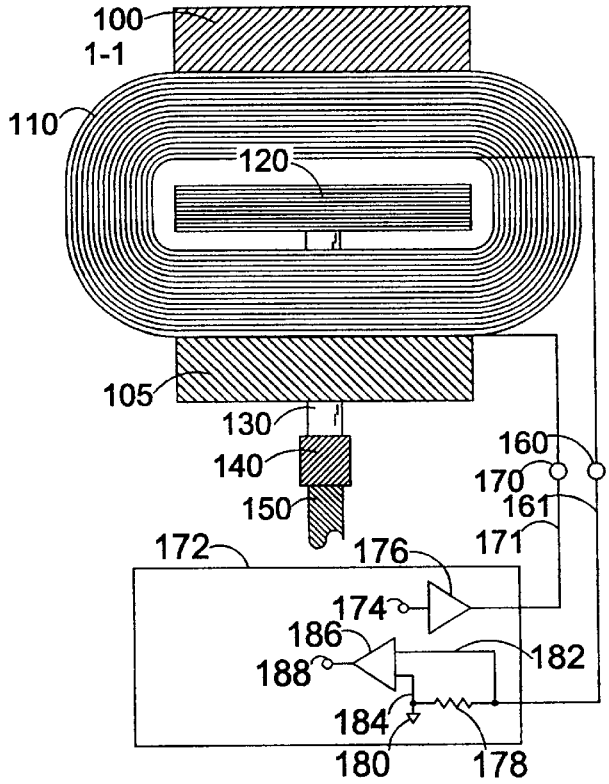

In the first category of embodiments, as illustrated in FIGS. 1*a* and 1*b*, each one of the turns of a single electrical winding loops from the top U-core to the bottom U-core, passing around both ends of the armature on each turn (excepting possibly the first and last turns). This single winding, for an equal number of turns fitting into a given winding window in either U-core, gives approximately the same winding resistance as a similar winding conventionally wound to excite either the top or the bottom U-core, singly, while two such windings would be needed to excite both top and bottom U-cores in a conventional topology. Thus, there is little or no winding resistance penalty for exciting both U-cores at once, compared with exciting just one of the two U-cores at a given time in a conventional winding topology. The magnetomotive force in this new winding topology is concentrated efficiently around the armature, encouraging flux flow in paths that include the armature and one or both yokes mutually in the looping flux paths, thus reducing the proportion of stray flux, i.e. flux linkage contributing to an unchanging stray inductance and not varying in response to changes in armature position. Stray flux does not contribute to electromagnetic force but does contribute to saturation of ferromagnetic solenoid components. There is a central armature location for which the winding inductance is at a minimum and for which the current-to-force coupling goes through zero. The top and bottom sides of the solenoid are made unsymmetrical for the armature at rest and not latched, to avoid a complete cancellation of axial forces at this rest position. One optional contribution to the asymmetry can be non-matching slopes of the mating armature and yoke poleface surfaces, e.g., flat surfaces on one side of the armature and sloping surfaces on the opposite side. Another option asymmetry contribution can be an off-center rest location of the armature in its travel range between latching positions against the top and bottom yokes. When asymmetries of non-matching slopes and off-center rest location are combined, they can enhance the capability to drive a valve load that experiences large, variable, and unsymmetrical losses of mechanical energy moving in just one direction, from closed to open positions. Magnetic asymmetries, as described, result in a non-vanishing net electromagnetic force coupling to the armature in its spring-neutral rest position, thus facilitating the process of driving a resonant armature motion and bringing the armature to a latching position.

Figure 2A:
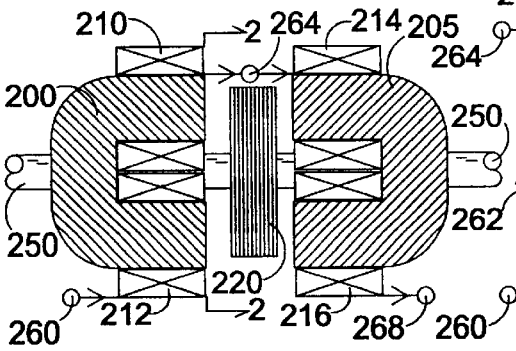
FIGS. 2*a* and 2*b* illustrate, in end-elevation section and cutaway plan views, a dual-latching solenoid consisting of four separate U-core yokes, two such yokes on either side of a single armature that moves between the two pairs of yokes. The figures show series connection of the sets of windings on either side of the armature, while on a given side, the windings on the separate U-cores are wired in parallel.

In the second category of embodiments, illustrated and explained in variations with reference to FIG. 2*a* and succeeding figures, armature, yoke, and winding configurations resembling those of the prior art are modified by series connection of winding elements on either side of the armature. Such series connection, creating a single effective winding from separate interconnected winding elements, reduces the electromagnetic circuits to be driven from two to one circuit per dual-latching solenoid.

Such an interconnection would appear to carry a heavy performance penalty, namely that by series connecting the windings in yokes on opposite sides of the armature, one doubles electrical resistance, thus doubling power losses while simultaneously causing a substantial cancellation of electromagnetic force over much of the armature travel where force should be exerted. A deeper investigation indicates a smaller negative impact on performance, making simplification worthy of consideration where a superficial examination might lead to rejection of the idea out of hand.

First comes the false expectation of doubling power losses by driving two windings in series when only one of the two windings is performing useful electromechanical work. Except for a nearly centered armature, the winding closer to the armature may be considered "active" and engaged in doing electromagnetic work, while the winding farther from the armature may be considered "inactive" and of zero or negative utility. Better, it would seem superficially, to provide separate circuitry for each winding in order to drive only the active winding. In practice, in a dual-latching valve actuation solenoid, winding resistance is significant but not an overwhelming majority in the overall energy loss picture. Resistance is the primary "static" energy loss, i.e. a frequency-independent loss of power, effective down to DC. Dynamic losses depend on rate of change or total change in magnetic flux. Major sources of static loss include the obvious winding resistance, but also significant non-winding circuit resistances of transistors, circuit board foils, wiring, and connection contacts. Dynamic losses include magnetic hysteresis, eddy currents, and mechanical friction. While static resistive power loss varies as resistance times the square of current, the dynamic electrical power losses, both from eddy currents and hysteresis, vary roughly as the square of magnetic flux amplitude. Considering two windings, one "active" and the other "inactive" at a given time, a given current generates, by definition, less magnetic flux linkage in the inactive winding and throughout the associated ferromagnetic yoke, due to the larger magnetic gap bridging to the more distant armature. With the approximate square law amplitude dependence of dynamic losses, the dynamic energy loss to the inactive side of a dual-acting solenoid is generally well below the dynamic loss to the active side.

Dynamic loss in the armature requires separate consideration from a yoke. Static ferromagnetic yokes are generally mechanically robust and can be constructed of ferromagnetically efficient laminations, e.g. of a low-hysteresis annealed silicon steel, possibly grain oriented for even lower hysteresis, and with low eddy current losses due to the lamination structure. Armatures are not so easily optimized for low loss. Exposure of an armature to cyclic stress and shock can change the crystalline structure, defeating the advantages of annealing and raising hysteresis by a substantial factor. Breaking an armature up into lamination layers tends to weaken the structure mechanically. The best lamination orientation for fighting eddy currents tends to be the worst orientation for mechanical strength. Strength problems are so severe that it is common, in engine valve actuation solenoids, to employ a solid metal armature in preference to laminations. In solid metal, eddy currents are especially high, even if slots are used to reduce the losses. If laminated sheets are chosen and measures are to be taken to improve strength, welds or welded strips to strengthen a laminated armature create unwanted eddy current pathways, partially defeating the purpose of the laminations. A compromise lamination direction, flat in a plane perpendicular to axial motion, gives lower losses than in solid metal, though the losses are still significant. In practice, therefore, dynamic losses tend to be associated predominantly with the armature.

When an armature is within efficient pulling range from an active yoke, the inactive yoke is of little consequence. The peak flux through the armature is established at or near latching, with negligible influence from the inactive side. In mid transition, the fluxes coming from the two yokes can be made to add or to subtract, depending on the choice of winding polarity. In the high loss situation where the kinetic energy of the armature must be increased to overcome losses and reach a landing, the yoke (with separate drives) or yokes (with merged series drive) need to be energized beginning near mid transition, simply to allow time for slewing the total magnetic flux up to a range where a strong pull develops as the armature moves closer to home. If both yokes contribute to flux in the same direction across the armature, and if some significant armature flux level is maintained at all times from release on one side to capture on the opposite side, then the peak-to-peak flux change across the armature is less than half the peak flux amplitude: the flux never passes through zero. If the two yokes generate flux in opposite polarities, then the peak-to-peak flux amplitude across the yoke is double the average of the latching flux levels for the two sides. Clearly, dynamic losses in the armature are minimized by generating flux in the same direction from both yokes. Series-wound yokes are relatively efficient at maintaining a significant fraction of maximum armature flux as the armature crosses the middle range—the power efficiency for maintaining a given armature flux at mid-transition is twice as good for matched current through both yoke windings as for all the current and power going to one yoke winding. If the mid-range armature flux is just 30% of the peak flux, as opposed to zero, then the peak-to-peak flux swing is reduced from 100% to 70% of the peak flux. With dynamic losses varying roughly as the peak-to-peak flux swing, the implication is that dynamic armature losses are cut roughly in half by maintaining a 30% flux level across the middle. (Dynamic losses are roughly quadrupled if there is a full polarity reversal in the armature from side to side.) In the strategy of maintaining some armature flux, inductive voltages in the series connected yoke windings will automatically tend to transfer magnetic energy from the yoke with an opening gap toward the yoke with a closing gap.

Summarizing the dynamic loss picture, and not yet considering partial cancellation of magnetic forces in mid-transit, one may conclude that dynamic losses may be substantially reduced by maintaining some current at all times in series-wound yokes—or alternatively by overlapping the operation of both yokes in the more conventional setup with separate drives for each yoke.

We now consider relative losses due to series electrical resistance. In practical winding configurations for high-speed valve solenoids, magnetic flux must change from zero or a low maintenance level to a saturation level in a time period on the order of one millisecond or less, driven by a comparatively low voltage (e.g., 42 volts or less). The implication is that the number, "n", of winding turns must be quite small, e.g., less than 100 turns per yoke, in order to achieve the required change in flux linkage within the required time interval. With so few turns filling the armature window, resistance tends to be very low, e.g., around 100 to 200 milliohms per yoke winding in a typical engine valve actuator. Compared to such a low figure, resistances of on-state field effect transistors, circuit board foils, connector contacts, and wiring, tend to add up to a significant fraction of a winding resistance, or even to more than the resistance of a winding. Thus, the added series resistance of an inactive winding represents significantly less than a doubling of overall DC resistance, considering the non-winding contributions. Static latching power therefore increases by significantly less than double. With the economy of requiring one rather than two driver circuits, part of the saving can be put back into making the one driver more robust, with larger transistors and larger circuit board foils, thus reducing circuit losses and offsetting some of the increased static winding loss.

Another issue to be discussed is unwanted magnetic attraction from the "inactive" side of a dual-latching solenoid with series-connected windings. A formula for electromagnetic force in a non-saturated solenoid is given by Eq. 1:

$$F=\tfrac{1}{2}I^2\partial L/\partial x \qquad 1]$$

Here, "I" is the current that flows with equal strength through both "active" and "inactive" series windings. "L" is total inductance associated with the series windings, and "x" is axial armature position. If "x=0" designates an armature latching position, then the latching inductance "L(x=0)" is very high and dominated by inductance of the "active" (i.e. closed) side, and "L(x)" falls very steeply with increasing gap "x". In geometries like those illustrated in this Specification, Eq. 2 yields a good empirical fit to L(x) for one of the two series-connected yoke windings:

$$L=L_o(1+x_o/(x+x_{min})) \qquad 2]$$

The parameter Lo represents a leakage inductance, approached asymptotically as gap x increases to infinity. The lower limit of effective gap, xmin, is a small distance, typically a small fraction of a millimeter, related to imperfect mating of poleface surfaces and also to a small but finite reluctance of the ferromagnetic materials of the armature and adjacent yoke. The characteristic distance xo is related to poleface dimensions, commonly being on the order of 15% to 20% of the minimum dimension across a yoke poleface where it mates with an armature surface. When the sum (x+xmin) is less than xo, then the inductance derivative $\partial L/\partial x$ varies roughly inversely as the square of (x+xmin), while $\partial L/\partial x$ declines faster than an inverse-square law for (x+xmin) exceeding xo. This "elbow" at xo for rapid decline of the inductance derivative $\partial L/\partial x$ occurs typically at less than 25% of peak-to-peak armature travel between latching positions. The implication is that the force response between yoke and armature is very attenuated for armature positions between 25% and 75% of travel from stop to stop. While force cancellation with series-connected yoke windings is significant only in this middle 50% of armature travel, the force coupling in this region is already so small that little useful electromechanical work can be accomplished in this region. Virtually all the work of pulling an armature in for latching, or of slowing an armature that is leaving a latching state with excess energy, must be accomplished in the regions between 75% and 100% of travel and between 0 and 25% of travel from stop to stop. Unwanted attraction from the "inactive" side of series-connected yokes is thus of negligible concern as a power consumption issue in common engine valve designs.

Concern about unwanted inactive-side attraction arises only for the purposes of starting the motion of an armature from rest. Clearly, starting a stopped armature must be accomplished by gradual accumulation of oscillatory amplitude, driving the system at its mechanical resonance. With only small electromagnetic forces available for the rest position of the armature, starting can be achieved only with a relatively undamped resonant motion of the armature. For series-connected yokes, resonant starting will work only when there is a sufficient asymmetry in the solenoid system, so that the force balance point is not too close to the spring-neutral resting point of the armature. Useful approaches to intentional asymmetry are discussed later.

Another issue concerning series connection of yoke windings is variable inductive loading. As seen above in relation to Eqs. 1 and 2, most of the inductance of a series-connected pair of yokes comes from the "active" yoke and winding, i.e. from the side operating at a smaller magnetic gap. High peak power levels are typically required to pump energy into, or out of, an inductive solenoid load, thereby increasing or decreasing magnetic attractions through large fractional changes in fractions of a millisecond. For generating force across large gaps, where the quantity "$\partial L/\partial x$" of Eq. 1 is quite low, current "I" must be quite high, and drive circuitry must pump substantial power into a very low impedance load. When force corrections are being applied to control a solenoid landing path in the final approach to magnetic closure, high voltages are needed to slew magnetic flux up and down rapidly to change force, even though the currents employed remain in a low range—necessarily, if magnetic saturation is to be avoided for small magnetic gaps. It becomes challenging to achieve an economic driver design to handle high peak power (e.g., well over one kilowatt) and an even higher product of capacities for non-simultaneous peak-volts multiplied by peak-amps. In this context, the load seen by a driver does not become significantly more difficult to drive after series connection of opposing yokes surrounding an armature. The "inactive" yoke adds but a small fractional increment of inductance to the load, with reactive components of the "active" yoke dominating the load during active dynamic control. A potential performance and cost benefit to series wiring of yokes is that, as mentioned above, with a halving of the number of drive circuits, part of the cost saving can be recommitted to reducing circuit resistance and increasing peak current and power, by variously using larger and/or heavier circuit board foils, using larger transistors, using heavier wires, and spending more per electrical contact on the reduced number of contacts as required after the redesign for series connection of the yoke windings.

Series connection of yoke windings raises the issue of inference of armature position from relationships among winding voltage, current, and time. Background for this discussion of "sensorless" position inference, as described thoroughly in the Bergstrom patent (U.S. Pat. No. 6,249,418) mentioned above, is reviewed briefly here. If a position calculation can employ prior knowledge of solenoid properties, specifically of the function "L(x)" describing solenoid inductance "L" as a function of armature position "x", and if in addition one can estimate the net flux "ϕ" linking a yoke winding, then a measurement of current "I" leads to a mathematical solution for the unknown position "x". Specifically, position "x" is determined a function of the ratio of current divided by flux, "I/ϕ", yielding the inferred position function "x(I/ϕ)". Equivalently, one can describe a position function in terms of the reciprocal ratio of flux divided by current, "ϕ/I". Furthermore, as taught by Bergstrom, one can track changes in flux "ϕ" over time by subtracting resistive voltage from total winding voltage to obtain a pure inductive voltage, then integrating this inductive voltage over time to obtain changes in the flux-linkage product, "nϕ", which includes the number of windings "n" as well as the flux "ϕ".

How does this kind of position inference change with a single-winding dual-latching solenoid? For an armature well off-center, position inference is not significantly changed. The circuitry need only account for a slightly modified inductance curve due to the addition of inductance from the "inactive" side. Any correction for winding resistive drop, as part of computing inductive voltage, obviously incorporates a larger resistance in the impedance model when two windings are wired in series. In any case, one needs a nonzero current to utilize the ratio of current/flux to infer position.

For the conventional case considering one of two separate windings in dual-latching solenoid, the inferred position function "x(I/ϕ)" is single-valued and monotonic with the argument "I/ϕ". In the present case of a dual-latching solenoid with only one winding, the function "x(I/ϕ)" is double-valued. If the function is described so that "x" represents gap size and becomes small when the magnetic gap closes, then the function "x(I/ϕ)" becomes small when the armature approaches either of the two latching positions, closing the gap of either one of the two magnetic yoke assemblies sharing the common effective winding. Asymmetries in the solenoid, including asymmetries needed to get an unenergized solenoid started and latched on one side, can be used to infer on which side of center the armature is to be found. Determining armature position during dynamic transition from one side to the other requires special considerations. When the armature is near center travel, the controller can combine monitoring and controlling functions, either monitoring current at a controlled inductive voltage (e.g., zero inductive volts), or monitoring inductive voltage at a controlled current (e.g., at a probing bias current). Other combinations of current and voltage are possible, while the following examples for constant current and constant voltage illustrate a more general principle, applicable for control of varying combinations of voltage and current.

Figure 5:
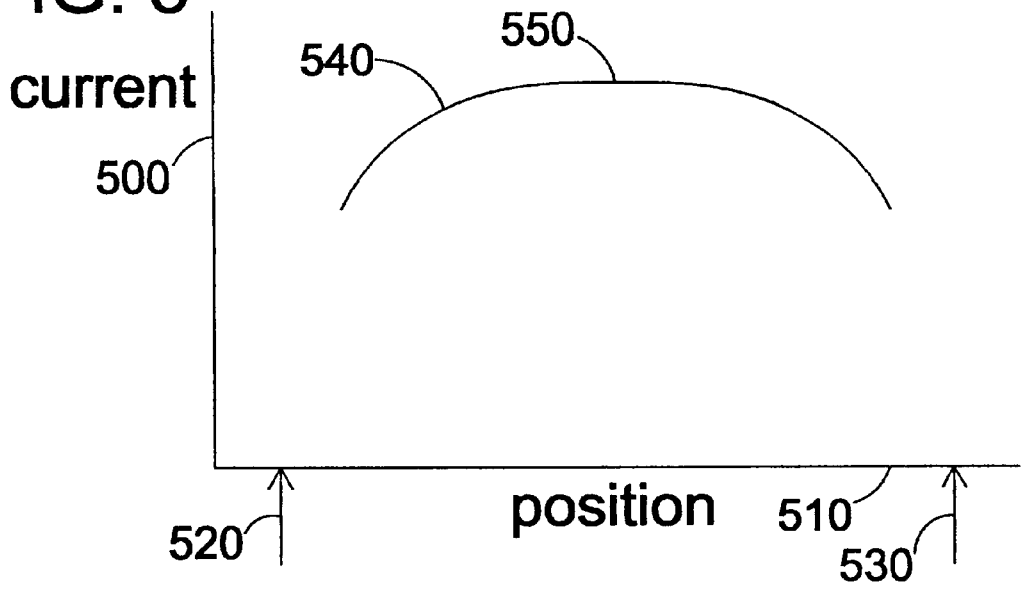
FIG. 5 is a graph representing winding current as a function of position, near center position, when magnetic flux linkage is maintained constant by maintaining inductive voltage near zero during that portion of armature travel.

With time-varying current flowing at zero inductive volts, the product of current and inductance, "IL", remains constant over time, being proportional to the constant flux linkage. Thus, current "I" varies inversely as the net inductance, "L", of the series windings, exhibiting a maximum current at the point of minimum inductance. For the purposes of controller programming, this minimum inductance can be measured in advance, representing a constant parameter of the solenoid. The armature position for minimum inductance is similarly known, as is the ratio of current to flux at this minimum inductance. Thus, the absolute value of flux is determined from the maximum value of the graph of current. Following this flux determination, armature position becomes a known function of the measured current. FIG. 5 illustrates a representative graph of current as a function of position, near center, when net flux linkage is held at a constant non-zero value by maintaining zero inductive volts. The second derivative of this time-varying current function about its maximum value, divided by the current value at the maximum, is proportional to armature velocity at the crossing of minimum inductance. This measure of velocity, or equivalently of kinetic energy, is useful for anticipating control actions needed to achieve a soft landing.

Figure 6:
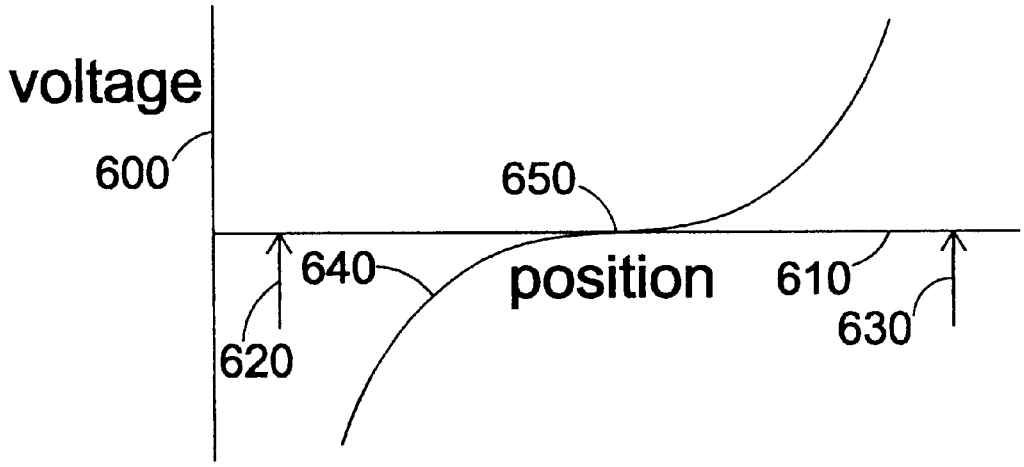
FIG. 6 is a graph representing winding inductive voltage as a function of position, near center position, when winding current is maintained constant during that portion of armature travel.

At constant winding current, inductive voltage will cross zero at the point of minimum inductance, reversing the flow of inductive energy, as illustrated in FIG. 6. In this case, the voltage graph is a monotonic indication of the product of time-varying position and velocity, provided that one already knows the direction of armature motion. At the zero-crossing of the graph, and for a predetermined constant current, the slope of the voltage graph is proportional to the square of velocity and to the first power of kinetic energy. The magnetic flux or flux linkage has a defined value at the voltage zero-crossing, being proportional to the applied constant current. Once this absolute value of flux is obtained, time-integration of inductive voltage provides the variation in flux over time, yielding a known flux at all times from the minimum-inductance crossing until landing. With flux being known over time, and with the ratio of current to flux being known in advance as a function of the solenoid position, position becomes defined as a function of time after the minimum-inductance crossing, using methods previously described by Bergstrom (op. cit.) and others.

The description just given may be slightly in error, due to the effects of magnetic losses associated with hysteresis and eddy currents. Specifically, the indication of minimum inductance, either as a current maximum or an inductive voltage zero-crossing, may be delayed slightly by magnetic losses. This will be true even at constant flux linkage through the winding, since the geometric distribution of flux varies with armature position even as the winding flux linkage remains constant. For example, at constant flux linkage through the winding, armature flux will fall to a minimum at the minimum-inductance point, and the subsequent rise in armature flux will be held back by magnetic hysteresis, producing a skew in the graph of current. This skew is a knowable effect that can be corrected in the data interpretation.

Summarizing, sensorless two-wire servo control of solenoid motion can be accomplished in conjunction with the two-wire dual-latching solenoids described herein, through adaptation of prior-art methods to this very different control situation. Departing significantly from the control practices of the prior art, however, control is now exerted via two wires per pair of yokes, rather than two wires for each of two separately-driven yokes in a dual-latching solenoid. Successful control in the new context utilizes three determinations not found in the prior art. First, the time of crossing the magnetic center point, or point of minimum inductance, is determined from some combination of current and voltage data (e.g., from voltage at constant current or current at zero inductive voltage), giving a very useful time reference for subsequent actions to control solenoid landing. Second, the velocity and kinetic energy of the armature can be determined in the vicinity of mid-travel, again providing useful anticipatory control information. Third, the known value of inductance at the detected minimum inductance provides an opportunity to initialize or reinitialize an integration from inductive voltage to flux, so that flux is subsequently known in absolute terms and can be used for inferring the changing position of the armature for landing servo-control. This information is all derived by a "sensorless" method, that is, by inference of position, flux, and related parameters like force, from current and/or voltage data and without sensors in the solenoid (apart from the drive winding itself, whose measured current/voltage response provides the needed sensing information.)

Embodiments Whose Windings Encompass the Armature

As illustrated in the views of FIGS. 1*a* and 1*b*, a dual U-core embodiment includes top and bottom U-core yokes 100 and 105, providing high and low latching yokes for armature 120, with magnetomotive force produced by a single winding 110, seen passing through the middles of both U-cores and out around the ends of the armature. The mating surfaces of armature 120 are flat on the top surface and tapered on the bottom surface at either end, e.g. at 125 on the left end, mating with matching sloped surfaces of yoke 105. Armature 120 is guided by side-by-side shafts 130 and 135, on the left and right in FIG. 1*a*, which are guided by bushings, not shown, in yoke 105. Magnetic rotational instability about the axis of travel and of shaft 150 is overcome by the side-by-side shafts 130 and 135. These shafts are joined together by block 140, which in turn couples to single centered shaft 150, which may act as a push rod to open an engine valve. Note in FIG. 1*a* that arrows labeled "1" below shaft 150 and above yoke 100 indicate where the section view of FIG. 1*b* is taken, while the "1—1" label in FIG. 1*b* indicates the cross section corresponding to the arrows of FIG. 1*a*. Compression spring 137 pushes outward between yoke 105 and block 140, exerting a downward force on 140, while compression spring 142 pushes up on block 140 and is supported from below by components not shown, e.g., part of an automotive cylinder head. Springs 137 and 142 are shown only in FIG. 1*a*, not in the view of FIG. 1*b*. The spring system consisting of 137 and 142 and the supporting surfaces for these springs results in a restoring spring rate coupled to armature 120, with a spring-neutral position somewhere between the upper and lower magnetic latching positions of 120. This armature is drawn in its spring-neutral position in FIGS. 1*a* and 1*b*, this position being slightly below the midpoint of travel between upper and lower latching positions against 100 and 105. At the below-center armature position shown, the magnetic reluctance across the lower magnetic gaps between sloping surfaces is lower than the reluctance across the upper magnetic gaps between flat surfaces. Even if the armature were centered axially in its travel range, the cosine factors of the lower surface slopes would make those mating surfaces effectively closer together, lowering the reluctance for equal mating areas, as drawn. The below-center armature location increases the reluctance asymmetry. There is a net downward magnetic force on armature 120 when a current flows through winding 110. Modulation of this force can be used for resonant starting of the solenoid, leading to latching on a chosen side.

Terminals for connecting winding 110 are shown at 160 and 170, here connected to a controller circuit 172 via wires 161 and 171. Though the configuration of this controller circuit may vary, the illustration shows a voltage driver 176, driven by a signal applied at 174 from inside the controller, and a current sense circuit based on the differential voltage developed across sense resistor 178. As drawn, 178 is connected on one side to wire 161 going to the coil interconnection at 160, and to wire 182 going to a differential input of amplifier 186. The other side of 178 is connected to ground 180 and to the opposite differential input of amp 186 via wire 184. The output of amplifier 186 at 188, the current sense signal, is used in the controller in ways explained elsewhere. Specifically, the voltage drive and current sense can be used to create a near-zero inductive voltage in the coil, offsetting resistive voltage components, while current is monitored for a maximum value at a crossing of the armature position for minimum inductance. Alternatively, feedback from 188 to 174 can be used to create a controlled, constant output current, while the required voltage is offset to obtain an inductive voltage component, that component being monitored for a zero-crossing. When the inductive voltage crosses zero at constant current, inductance has crossed through a minimum value, marking a known armature location at a known time. Again, absolute flux can be computed for this location and time.

Figure 3A:
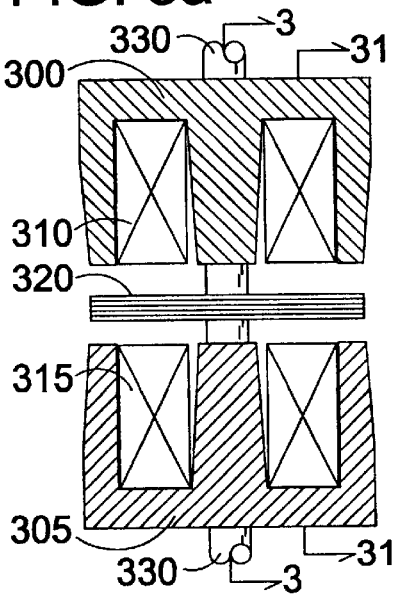
FIGS. 3*a* and 3*b* show, in views like those of FIGS. 1*a* and 1*b*, a dual-latching solenoid consisting of over-and-under E-core yokes around an armature. Windings on the two E-cores are series connected to form a single electrical winding circuit.

Two disadvantages of the configuration of FIGS. 1*a* and 1*b* are difficulty of assembly and the necessity of splitting shaft 150 into "branches" 130 and 135 for getting around winding 110. Overcoming one of these disadvantages, use of a central shaft works for an E-core variation on the U-core topology, illustrated as follows. Consider a solenoid for which FIG. 3*a* represents and end elevation view and FIG. 1*b* represents the corresponding side elevation view. Ignore FIGS. 3*b* and 1*a*, which do not apply to the topology being considered. The side elevation section is defined by the pair of bent arrows labeled "31" in FIG. 3*a*, which define a cut through the middles of the upper and lower winding sections to the right of center, opposite 310 and 315. These winding sections on the right are interpreted as slices through a single winding like 110 in the view of FIG. 1*b*, looping out and passing vertically around the ends of armature 120, which is interpreted as being the same armature as 320 of FIG. 3*a*. Similarly, 310 and 315 are interpreted to be two section cuts through a single winding to the left of the center posts of E-cores 300 and 305 of FIG. 3*a*. This topology could be made to work using either series or parallel interconnection of the left hand and right hand windings. In either case, the interconnection is polarized so that the vector current rotation senses in the two coils is oppositely directed, e.g., reinforcing a north polarity in the E-core tongues between the windings and a south polarity in the tongues to the outsides of the windings, on the left and right in the view of FIG. 3*a*. Electromagnetically, this use of left and right windings performs similarly to the use of series-connected top and bottom windings indicated by the combination of views in FIGS. 3*a* and 3*b*.

Figure 3B:
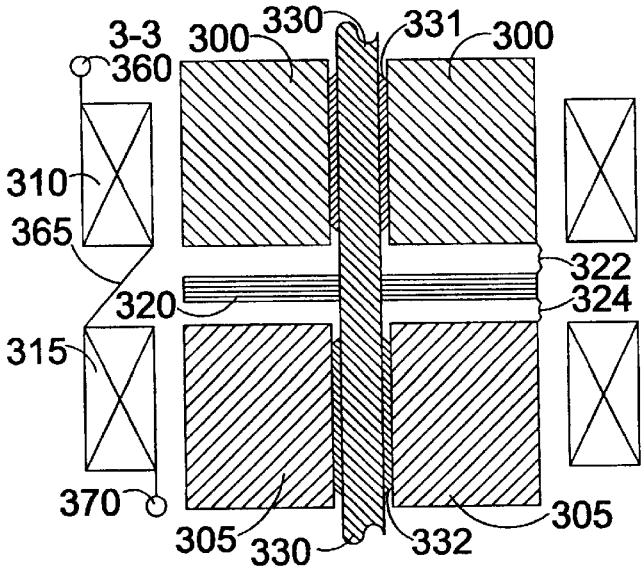

One readily infers certain constraints on the order of component assembly in this hybrid of FIGS. 3*a* and 1*b*, leading to the possible conclusion that assembly of the embodiment of FIGS. 3*a* and 3*b* would be easier. Depending on details of geometric proportion, electromagnetic performance is likely to be better for the embodiment with separate left and right coils, each looping around the ends of the armature. The side-by-side coil configuration is likely to suffer less stray flux and therefore generate better pull across relatively large magnetic gaps, both under conditions of matching ampere-turns and where magnetic saturation imposes a limit on the maximum pull across a gap. The curving end portions of the side-by-side windings orient better in relation to the armature, promoting armature flux in a transverse direction. By contrast, the end portions of the windings in FIGS. 3*a* and 3*b* promote more flux in the yoke, a larger proportion of which tends to leak between the tongues of the E-cores without reaching across to link the armature.

Not drawn but worth mentioning is another variation on the U-core geometry of FIGS. 1*a* and 1*b*. The single winding 110 in those figures can be wound initially as separate left and right pancake halve, which are subsequently formed to take a detour in the middle around a central shaft, after which the interconnected pancakes are joined physically. Thus, instead of using split shafts 130 and 135, the modified design uses an extension of shaft 150 up through the armature, through both yokes, and through the detour formed between the middles of the pancake halves of the winding. Some lamination material is removed from yokes 100 and 105 to accommodate the wiring detour, the central shaft extension of 150, and bushings that may be incorporated to guide that shaft. In a central shaft configuration, provision must be made for rotational stabilization of the armature, unless the sloping faces of the lower yoke and armature are replaced by flat faces, e.g., as illustrated in FIG. 2*a* and discussed below.

Embodiments Whose Windings Do Not Encompass the Armature

Figure 2B:
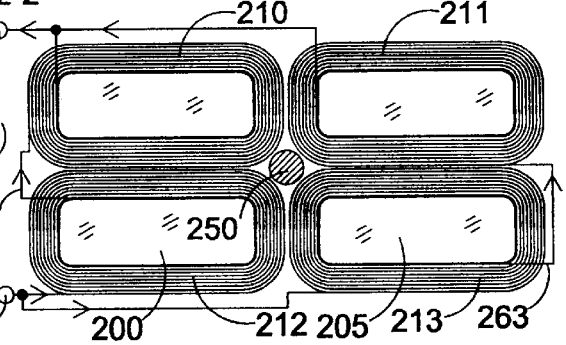

FIGS. 2*a* and 2*b* illustrate an alternate U-core embodiment, now using end-to-end U-cores on both the left and right sides of armature 220, where the left-right direction of armature travel in FIG. 2*a* replaces the up-down direction of armature travel in FIG. 1*a*. The dual arrows marked "2" in FIG. 2*a* indicate the direction for the cutaway plan view marked "2—2" in FIG. 2*b*. U-core yoke 200, seen on the left in FIG. 2*a*, is rotated under in FIG. 2*b*, so that one looks down on the pole face surfaces of 200 on the left side of FIG. 2*b*. The comparable pole face surfaces 206 seen on the right in plan view 2—2 are hidden behind the viewed cross section of FIG. 2*a*. Yoke 205, opposing yoke 200 in FIG. 2*a*, across armature 220 on the right, is cut away and would lie above the viewed surfaces of FIG. 2*b*. Keeping these orientations in mind, one sees that the solenoid structure includes four similar yoke components, two on each side of armature 220. Each yoke component is wrapped by two windings, e.g., 210 and 212 about 200, 214 and 216 about 205, 211 and 213 about 206, and two unseen windings about a fourth unseen yoke component lying below the view of FIG. 2*a* on the right, and above the view of FIG. 2*b* on the right. Shaft 250 penetrates and supports armature 220 and is guided by bushings (not shown) set between the pairs of yoke components. The shaft just clears through a cusp between the four windings seen in FIG. 2*b*, and similarly for the four windings lying above the viewed plane of FIG. 2*b*. Armature 220 is restored to a spring-neutral position by springs, not shown. A spring-neutral position is indicated for 220, off-center to the right between the yokes as seen in FIG. 2*a*. This off-center position provides a magnetic asymmetry for starting a resonant motion of the armature and spring system. The system of FIGS. 2*a* and 2*b* lacks a pole-face slope asymmetry of the sort indicated by sloping surface 125 of FIG. 1*a*. If sloping pole faces were used in the system of FIGS. 2*a* and 2*b*, the resulting magnetic rotational instability would need to be offset by some method other than that provided by the dual-shaft configuration shown with shafts 130 and 135 of FIG. 1*a*. Note that the winding counts for the yokes on either side of the armature need not be matched from one side to the other, so that winding asymmetry is another way to generate a magnetic imbalance force for initiating armature motion from a spring-neutral rest position. The eight windings are wired as follows: For the layer shown in FIG. 2*b*, nominal positive current flows from terminal 260 to the outside of winding 212, counterclockwise around 212 to the center, across from the center of 212 to the outside of 210 via 262, clockwise around 210 to the center, and out to terminal 264. The opposing counterclockwise and clockwise rotation senses drive magnetic flux (by a right-hand rule) up out of the lower poleface surface of 200 and down into the upper poleface surface of 200, i.e., the rotation senses reinforce flux flow through the U-core. With cores 200 and 206 located end-to-end on one side of 220, windings 213 and 211 around 206 are wired to terminals 260 and 264 electrically in parallel with windings 212 and 210. Thus, neglecting winding resistance, the inductive voltages associated with cores 200 and 206 are forced to match, meaning that the flux linkages through the windings surrounding 200 and 206 tend to track each other over time. Comparing windings on opposite sides of armature 220 in FIG. 2*a*, one sees a series interconnection, from terminal 260 to 264 for the windings to the left of 220, and from 264 to 268 for the windings to the right of 220, in series-parallel combination analogous to that shown in FIG. 2*b* for the removed layer above the plane viewed in FIG. 2*b*.

FIGS. 3*a* and 3*b* show a dual E-core topology in views analogous to those of FIGS. 1*a* and 1*b*. The cross-section indicated by arrows numbered "3" above and below in FIG. 3*a* is labeled "3—3" in the side section view of FIG. 3*b*, here slicing through the middle of shaft 330 (unlike earlier sections views, which miss the shafts), revealing guide bushings 331 and 332 around the upper and lower extensions of shaft 330 from its penetration of armature 320. These bushings are set into cylindrical holes through the centers of E-core yokes 300 and 305. Windings 310 and 315 pass trough the slots of E-cores 300 and 305 and out around the ends. These two windings are series-connected to form a single electromagnetic circuit, going from terminal 360 via winding 310 to interconnection 365, and from there via winding 315 to terminal 370. Mating armature and yoke surfaces are flat. A spring system, not shown, restores armature 320 to a spring-neutral position, where 320 is drawn. Gaps 322 and 324, indicated by curly brackets, are unsymmetrical, with upper gap 322 exceeding lower gap 324 to put 320 below center in the illustrated spring-neutral position. As with the system of FIGS. 2*a* and 2*b*, this axial offset asymmetry generates a non-zero force coupling for starting motion in the armature.

Figure 4:
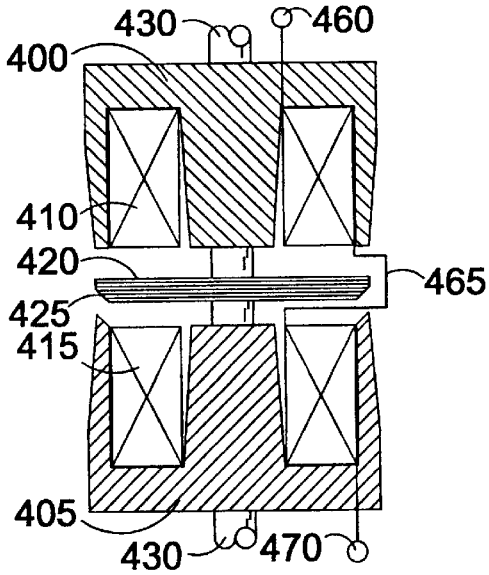
FIG. 4, resembling FIG. 3*a* with adjusted proportions, represents an elevation section view of a dual-latching solenoid with over-and-under pot core yokes acting on a central circular armature. As in FIGS. 3*a* and 3*b*, the windings in the upper and lower pot cores are series connected to form a single electrical winding circuit.

In the solenoids of both FIGS. 1*a* and 1*b*, and FIG. 4, the sloping mating surfaces on the lower sides of the armatures will result in greater pull at a distance, as compared to the flat surfaces above, for a given axial distance from mating on the one side or the other, and for a given current. Offsetting the advantage of greater pull at a distance is lesser maximum pull at magnetic saturation for the sloping surfaces. Thus, less peak force is available for latching the armatures down, as opposed to up. For linear springs and below-axial-center spring-neutral positions as indicated, less axial force will be required for latching the armatures low, as opposed to high. Thus, the sloping surface asymmetries complement the latching force asymmetries for peak force. With the below-center neutral positions of the armatures, and with an engine valve opening with downward movement of either armature (as pushed open by descending push rod 150 or 330), the spring always gives the valve an extra boost in one direction, while demanding an extra magnetic boost in the opposite direction. In the absence of gas pressures, soft landing of armature 120 or 320 in the downward, valve-open position calls for a magnetic braking force from the top yoke after release from latching high, to absorb excess mechanical potential energy associated with the downward trip. Similarly, soft landing in the upward, valve-closed position calls for a quick and complete magnetic release from below, followed by a pull from above to overcome an energy deficit and bring the armature up to latch. In the case of an exhaust valve opening against a strong opposing gas pressure force, the higher downward spring force assists in getting the valve opened against pressure. Once the valve is opened and downward armature motion initiated, the spring boost and the efficient downward magnetic pull at a distance will combine to help overcome the energy lost to gas dynamic forces. Part of the gas energy deficit is "saved" for replenishment on the return upward trip of the armature. Thus, although the unsymmetrical solenoid designs call for unsymmetrical actuation control to achieve soft landings in both latching positions, the asymmetries are designed to improve the capacity of the actuators for moving against gas loads, which are large only for motion toward valve-opening (since large pressure differentials are not supported for a valve initially open and moving toward closed.)

FIG. 4 is analogous to FIG. 3*a*, showing proportions appropriate for a pot core solenoid. Axial shaft 430 penetrates disk-shaped armature 420, which is tapered on the lower outer mating perimeter at 425 to match the taper of the complementary lower pot core 405, while the upper pot core 400 is flat, mating with a flat upper surface of 420. In axisymmetric pot core solenoids, there is no issue of rotational instability associated with poleface taper, unlike embodiments described earlier. Windings 410 and 415 are wired in series via a start terminal at 460, a series interconnection wire 465, and a finish terminal 470, to form a single electromagnetic circuit with the two terminals 460 and 470. Armature 420 is located in a spring-neutral position (springs now shown), below center. The taper asymmetry and the below-center spring-neutral position work together to reinforce the magnetic asymmetry of greater pull from the lower yoke for equal ampere-turns in both yokes, to facilitate both starting the solenoid and load matching for substantial gas dynamic energy losses with downward armature motion.

Control Information in the Embodiments

In the context of "one coil" dual-latching solenoid designs, the graphs of FIGS. 5 and 6 illustrate, qualitatively, ways to infer position, velocity, kinetic energy, and absolute flux, when the armature passes a position of magnetic symmetry somewhere not far from the geometric center position between latching positions. These latching positions are indicated by arrows 520 and 530 on position axis 510 of FIG. 5, and similarly by arrows 620 and 630 on position axis 610 of FIG. 6. In FIG. 5, with vertical current axis 500, current graph 540 reaches its maximum at symmetry position 550. Graph 540 is based on solenoid operation at constant flux, as achieved by using the solenoid drive signal to cancel a calculated resistive voltage drop in the coil, causing the inductive voltage to be nearly zero during the center transition. Graph 540 is not extended to the extreme positions 520 and 530 since, with normal controls, flux would not be maintained constant in the vicinity of latching positions, but would be varied to achieve latching and soft landing. It is seen that the current graph is relatively flat near the center, curving more steeply as the armature nears one of the other latching portions of the magnetic yoke assembly. The location of maximum current at 550 indicates the passing of a known armature position, for which the potential energy in the restoring spring is a known, relatively small value (since the position is not too far from the spring-neutral position.) Graph 540 is a function of position. Data obtained by a controller will arrive as a function of time. The curvature of the graph or current versus time around the maximum current is a quantitative indication of armature velocity, therefore of kinetic energy, and therefore of the total mechanical energy (potential plus kinetic) of the armature and valve assembly. This information is useful for control to achieve soft landing. The value of current at the center position 550, which corresponds to a known minimum inductance, leads to an initialization or re-initialization of the flux integral, permitting future tracking of flux and position and determination of magnetic force without extra sensors.

FIG. 6 applies to a system like that of FIG. 5, except that the vertical axis is voltage axis 600, trace 640 is inductive voltage, and a zero-crossing with inflection at a minimum positive slope is encountered at 650. Here, current is constrained to be constant, and the computed resistive voltage across the coil is subtracted from the voltage reading graphed by 640. The zero crossing indicates the known symmetry position, while the slope of the graph at this position at a known current varies as the square of velocity. The flux at this center position is a known multiple of the imposed constant current.

Observe that the control methods described above, for identifying the time of crossing of a minimum-inductance position and subsequently determining absolute flux and subsequent position and velocity information, applies to any single-winding dual-latching solenoid, including for example the solenoid taught by Sagem (op. cit.)

Similar schemes will be inferred, using neither constant flux nor constant current, but rather any approach in which the known relationships, as just described in two specific instances, apply to data interpretation. In any case, one can infer the time for crossing a known position, the velocity and kinetic energy at that time, and the absolute value of magnetic flux.

All the illustrated embodiments of the invention share common inventive features. These include magnetic asymmetry at a spring-neutral position for starting. They include winding topologies that provide attraction forces for closure and latching to either of two magnetically separated latching yokes, based on electrical drive to a single pair of terminals. By the lack of magnetic bridging between yokes on axially opposite sides of the common armature, the embodiments enjoy smaller footprints and significantly less stray flux leakage than the solenoid taught by Sagem (op. cit.). The dual U-core topology with a single monolithic winding, looping top-to-bottom, offers advantages of good coupling from the winding to the intended armature flux path and of low winding resistance in a fairly space-efficient profile, but with potentially offsetting disadvantages of difficult assembly and a requirement of dual bushed side-by-side shafts, typically joining below to a single central shaft. A variation with a formed winding detouring around a central shaft was described above. The other topologies, using series-connected windings, offer simpler assembly but use more wire, are less space efficient, and give higher winding resistance for a given winding turns count. The E-core topology of FIGS. 3*a* and 3*b* will require means (not shown) for resisting a destabilizing magnetic torsion about the axis of linear armature travel. These and other inventive elements will be expressed more thoroughly by the following claims.

What is claimed is:

1. A dual-latching solenoid system, comprising:

a) a first yoke;

b) a second yoke, magnetically separate from said first yoke;

c) an armature, movable between a first latching position adjacent said first yoke and a second latching position adjacent said second yoke; and, d) a single effective winding, for controlling motion of said armature, including for maintaining said armature in said first and said second latching positions.

2. The system of claim 1, wherein said single effective winding includes multiple turns looping through said first yoke and said second yoke while completing loops encircling said armature.

3. The system of claim 1, wherein said single effective winding includes:

a) a first set of turns completing loops encircling parts of said first yoke;

b) a second set of turns completing loops encircling parts of said second yoke; and, c) a series interconnection between said first set of turns and said second set of turns.

4. The system of claim 1, further comprising means for restoring said armature toward a neutral position between said first latching position and said second latching position.

5. The system of claim 4, wherein said neutral position of said armature is not at a position of electromagnetic force balance, whereby it is possible to move said armature from said neutral position by applying an electric current to said single effective winding.

6. The system of claim 1, further including controller means responsive to the inductance of said solenoid passing through a minimum value.

7. The system of claim 6, wherein a value of magnetic flux linkage through said single effective winding is determined as a function of the current determined when said inductance is said passing through said minimum value.

8. The system of claim 7, said controller means further including means for determining armature position over time, said means being based on said value of said magnetic flux linkage and on current and inductive voltage in said effective winding.

9. In a solenoid with one coil and two latching armature positions, a method for determining a time of arrival of armature position at a predetermined position between said two latching positions, said method comprising steps of:

a) determining inductive voltage over time in said one coil;

b) determining current over time in said one coil; and, c) determining said time of arrival, responsive to a minimum inductance of said coil.

10. The method of claim 9, wherein said determining said inductive voltage consists of causing said inductive voltage to be near zero over said time, said determining said current consists of measuring said current over said time, and being said responsive to said minimum inductance consists of being responsive to a maximum of said current.

11. The method of claim 9, wherein determining said current consists of causing said current to be nearly constant over time, and being said responsive to said minimum inductance consists of being responsive to said inductive voltage crossing through zero.

* * * * *